US006643868B2

(12) United States Patent
Reinhard et al.

(10) Patent No.: US 6,643,868 B2
(45) Date of Patent: Nov. 11, 2003

(54) PNEUMATIC MATTRESS

(75) Inventors: Andreas Reinhard, Zurich (CH); Rudi Leutert, Madiswil (CH)

(73) Assignee: Prospective Concepts AG, Zollikon (CH)

( * ) Notice: Subject to any disclaimer, the term of this patent is extended or adjusted under 35 U.S.C. 154(b) by 30 days.

(21) Appl. No.: 09/980,165

(22) PCT Filed: Apr. 9, 2001

(86) PCT No.: PCT/CH01/00223

§ 371 (c)(1),
(2), (4) Date: Nov. 26, 2001

(87) PCT Pub. No.: WO01/50918

PCT Pub. Date: Jul. 19, 2001

(65) Prior Publication Data

US 2003/0070237 A1 Apr. 17, 2003

(30) Foreign Application Priority Data

Nov. 29, 2000 (CH) ..... 2318/00

(51) Int. Cl.[7] ..... A47C 27/08; A47C 17/38
(52) U.S. Cl. ..... 5/9.1; 5/706; 5/731
(58) Field of Search ..... 5/615, 706, 711, 5/712, 713, 715, 731, 900.5, 9.1

(56) References Cited

U.S. PATENT DOCUMENTS 2,657,716 A * 11/1953 Ford ..... 139/410
2,753,573 A * 7/1956 Barker ..... 5/712
3,205,106 A * 9/1965 Cross ..... 156/79
3,286,285 A 11/1966 Harvey, Jr.
4,169,295 A * 10/1979 Darling ..... 5/706
4,389,961 A * 6/1983 Parish ..... 114/345
5,833,291 A * 11/1998 Haugs ..... 294/119.3
6,230,342 B1 * 5/2001 Haugs ..... 5/607

FOREIGN PATENT DOCUMENTS

GB 2 082 900 A 3/1982

OTHER PUBLICATIONS

International Search Report as Completed by the ISA/EP on Feb. 21, 2001. in connection to Swiss Patent Application No. 2318/00 as filed Nov. 29, 2000.

* cited by examiner

*Primary Examiner*—Michael Trettel
(74) *Attorney, Agent, or Firm*—Jenkens & Gilchrist, P.C.

(57) ABSTRACT

A pneumatic couch includes an airtight envelope divided into a lower skin and an upper skin. The airtight envelope includes low-stretch material. The pneumatic couch also includes at least one valve for inflation with compressed air and deflation. Between the lower skin and the upper skin, a plurality of flexible webs are arranged running in vertical planes substantially parallel to each other. The flexible webs comprise low-stretch material and are joined over the entire length of the flexible webs both to the lower skin and to the upper skin. At an upper and a lower end of the couch, the airtight envelope overlaps the flexible webs and the lower skin and the upper skin are joined airtight. The airtight envelope overlaps an outermost web on a first and second long side and the lower skin and the upper skin are joined airtight. On one long side of the couch both the lower skin and the upper skin continue past the airtight joint, and are taken around a rear wall and joined to each other, and form a back part. The back part is substantially of the same length and shape as an adjacent web, and the rear wall is so constructed that the rear wall can be fastened onto a load bearing wall or to a suitable bearing construction. The couch thereby assumes the shape of a cantilever.

22 Claims, 2 Drawing Sheets

PNEUMATIC MATTRESS

FIELD OF THE INVENTION

The present invention relates to a pneumatic couch or bench seat.

DESCRIPTION OF THE RELATED ART

Pneumatic couches, as a rule called air mattresses, are generally known. They are as a rule laid on the ground or otherwise on a suitable underlay for use and mostly comprise a number of mostly longitudinal air tubes or chambers arranged parallel to each other and at least partly communicating.

The disadvantage of all previously known forms of construction of such pneumatic couches or bench seats consists in the already mentioned circumstance that a suitable underlay both for the application as a couch and also as a bench seat must already be to hand and their task as a rule is completed in the upholstering of the underlay mentioned.

SUMMARY OF THE INVENTION

The aim of the present invention is the production of a pneumatic couch or bench seat which manages without essentially horizontal underlays, is quickly made ready for use and can be stowed away again and can permanently be held ready for use at predetermined positions with little space requirement.

BRIEF DESCRIPTION OF THE DRAWINGS

The idea of the invention is more closely explained using embodiments and the attached drawings. Shown are.

DETAILED DESCRIPTION OF THE PREFERRED EMBODIMENT

Figure 1:
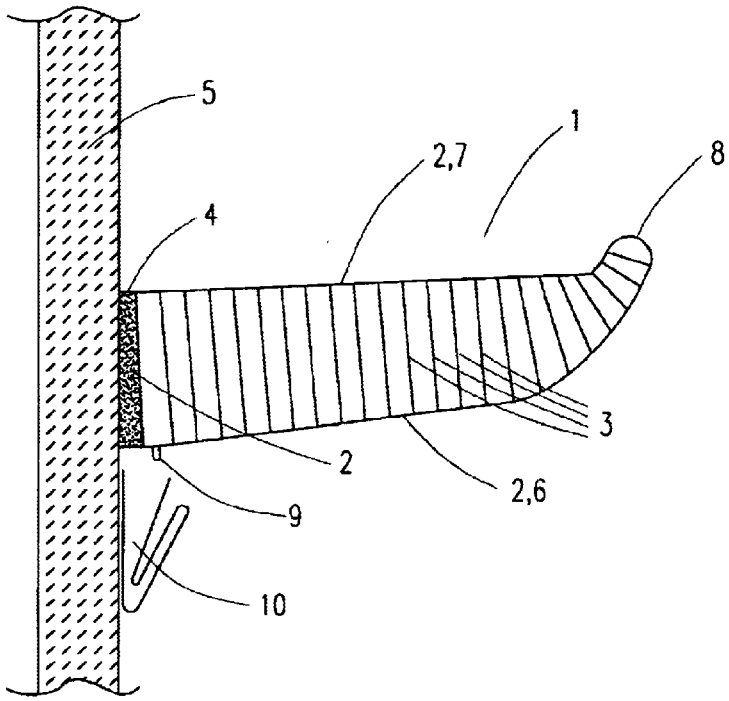
FIG. 1 a cross section through a first embodiment of a couch according to the invention, FIG. 2 a detail from FIG. 1, FIG. 3 a section from a longitudinal section through the embodiment in FIG. 1, FIG. 4 a longitudinal section through a second embodiment, FIG. 5*a* a section of a second embodiment of a textile web, FIG. 5*b* a section of a third embodiment of a textile web, and FIG. 6 an additional device according to an embodiment of the present invention as shown in FIG. 3.

FIG. 1 is a schematic cross section through a first embodiment of the invention, here constructed a couch 1. An airtight envelope 2 divided into a lower skin 6 and an upper skin 7 is manufactured from a low-stretch but however flexible textile material. For sealing, this material is for instance laminated with PVC. This envelope 2 encompasses the entire couch 1. Between the lower skin 6 and the upper skin 7 a multiplicity of similarly low-stretch for instance textile material webs 3 running essentially vertically are inserted. These are for instance glued to both skins 6, 7, or welded or sewn, and the stitching to the envelope 2 is then sealed. Towards the free outer edge of the couch 1 its cross section is constructed such that the couch 1 forms a light edge 8. The webs 3 can permit the passage of air and are constructed in the shape of elongate rectangles, so that the entire couch 1 which can be inflated with compressed air via one of more valves 9 remains at the same pressure. The height of the webs can be selected to be the same overall, or rather, as shown in FIG. 1, to decrease from the wall 5 to the free end of the couch 1.

This compressed air tensions both the envelope 2, which is also drawn over a back wall 4 for instance fastened to a wall 5, and also the webs 3. If now a person—not shown—lies on the couch 1, then it bends slightly downwards, which is to be anticipated from the shaping of the couch 1. The lower skin 6 is thereby freed from loading, that means that its tensile strain is reduced.

In the sense of an example of calculation the average height of the webs 3 is given by $h_s$, the length of the couch 1 by 1, its breadth by b and the weight of the person by $G_p$, the air pressure amounts to p.

The tension in the lower skin is thus in the condition unloaded by the person $$\sigma\frac{N}{m} = \frac{p1h_3}{2l} = \frac{1}{2}\mathrm{ph}_3 \qquad \text{Equ. (1)}$$

Under the simplified assumption that the weight of the person is applied as a line load of $$\frac{b}{2},$$

this generates a bending moment $M_p$, where $$Mp[Nm] = \frac{b}{2}G_p \qquad \text{Equ. (2)}$$

This is compensated according to the rules of the statics of cantilevers by $M_B$, where $$M_B = \frac{h_3}{2}\times 2\times\sigma l = h_B\sigma l \qquad \text{Equ. (3)}$$

By combination of these three equations there results $$p = \frac{b\cdot G_p}{h_B^2\cdot l} \text{ or} \qquad \text{Equ. (4)}$$

$$G = \frac{\mathrm{ph}_3^2\cdot l}{b} \qquad \text{Equ. (5)}$$

with the following numerical values b=1.0 m $h_s$=0.1 m l=2.0 m $G_p$=800 N

A limit value of 0.4 Bar results accordingly. Since this however depends quadratically on the average height $h_s$ of the webs 3, the limit pressure or the carrying capacity $G_p$ could be easily influenced by the height of the webs 3 or even by the breadth b of the couch 1. Instead of a wall 5, which is able to accept the required turning moment, this can easily be accepted by a carrying construction in the form of metal rails replacing the wall 5 or fastened to it.

Figure 2:
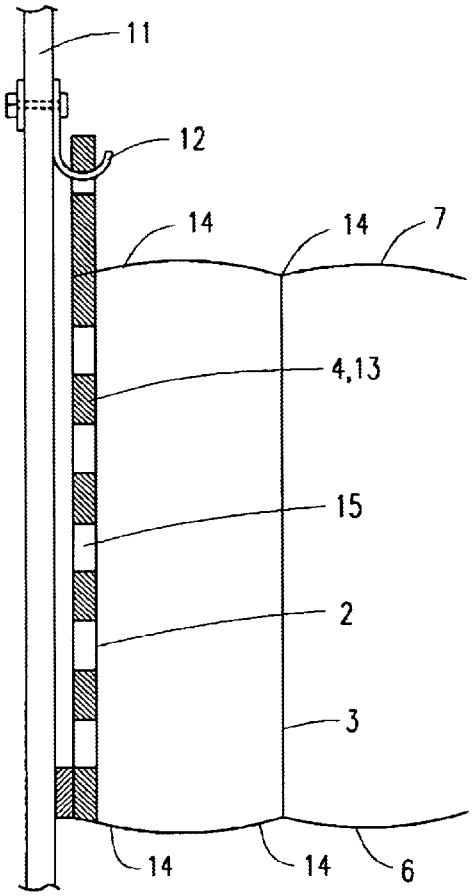

Instead of a fixed fastening of the rear wall 4 to a wall 5 obviously one such could arise in which the wall 5—or the elements replacing it—has two or more hooks. The rear wall 4 then carries rings at the corresponding positions, which are hung onto the hooks. FIG. 2 shows such an embodiment.

In FIG. 2, the static task of the wall 5 of FIG. 1 is taken on for example vertical rods 11, for instance square tubes. Each of these rods 11 carries a hook 12 fastened by conventional means. The rear wall 4 is here formed by for instance a perforated sheet 13. The perforated sheet 13 is positioned completely outside the airtight envelope 2, so that no lead-throughs have to be sealed.

Both the lower skin 6 and the upper skin 7 are joined to the webs 3 by means of T-shaped textile bands 14 running their entire length. The joints can be made by sewing, gluing or welding. If the joints are made by sewing the envelope 2, comprising the upper skin 7 and the lower skin 6 are sealed after the sewing. The two other T-bands 14 abutting the perforated sheet 13 are also joined to a rear part 15 of the envelope 2 enclosing the rear wall 4. These two named T-bands 14 and the rear part 15 accept the tensile forces of the envelope 2 without the connections having to be airtight. Instead of a perforated sheet 13 other configurations of the rear wall 14 are possible without departing from the idea of the invention. Essential to the invention is only the arrangement of the airtight part of the envelope 2 in front of the rear wall 4 and the part 15 behind it. In this way the separation of the functions in sealing and acceptance of forces is assured.

Such couches 1 according to the invention can for instance be used in tight dwelling conditions, in military or emergency accommodation, in vehicles, aircraft, cable railways and similar.

Figure 3:
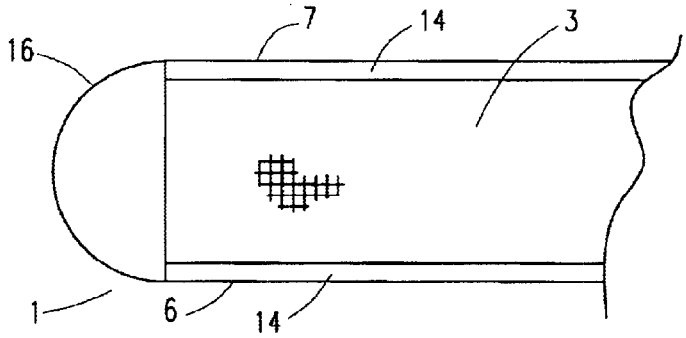

FIG. 3 shows one end of the couch 1 in longitudinal section; the other end is constructed symmetrically to that shown. The lower skin 6 and the upper skin 7 are joined in the region of the end of the couch 1 shown by a finishing part 16, which in the condition of the couch 1 inflated by compressed air is essentially semi-circular in section. The webs 3 retain the upper and lower skins 6, 7 parallel to each other in the longitudinal direction and extend however only over that region intended to be essentially parallel, so that the part of the couch 1 enveloped by the finishing part 16 joins the individual intermediate spaces between the webs 3. Thus the same air pressure acts overall even if the webs 3 are made impermeable. Obviously the region between the finishing parts 16 of the couch 1 can be given a form deviating from the even construction by suitable cutting of the webs 3.

Figure 4:
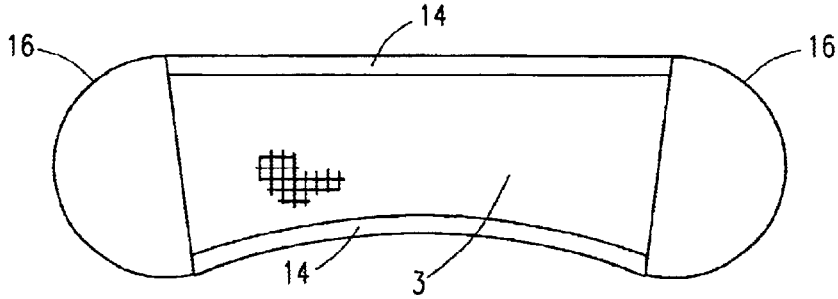

If the couch 1 is used mainly as a bench seat it is possible to take this into consideration by a change as mentioned to the cut of the webs 3, as shown in FIG. 4 with a person who sets himself down in the middle of the bench seat, as well as the actual sitting area the adjacent zones also carry with it. With a one-sided edge loading the outer lying zone is missing, so that the edge regions of the bench seat can be so configured according to the invention that they can carry the load working on them alone. This is—with an unchanged pressure—attained, with a glance at Equation (5), in that the webs 3 are made higher, whereby the carrying power increases quadratically with the height $h_s$ of the webs 3.

As the material for the webs 3, as stated above both textile weaves and also plastics material foils of low extensibility come into question. The lack of air permeability of foils is unavoidable, since—as shown in FIG. 3 and FIG. 4—the compressed air on the webs 3 can stream through the finishing parts 16 and the intermediate spaces between the webs 3 can thereby remain all under the same pressure.

Figure 5A:
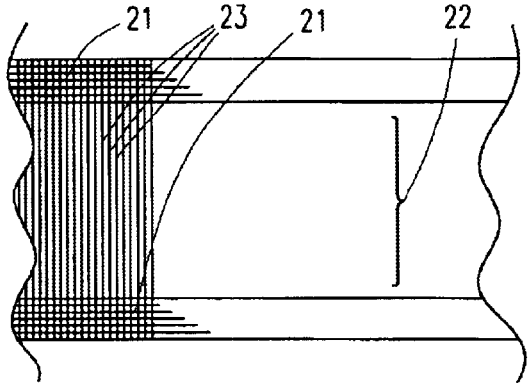

FIGS. 5*a, b* are schematic representations of further embodiments of the webs 3 according to the invention. Both embodiments are woven bands 20, which however differ in the selected binding.

The embodiment according to FIG. 5*a* is constructed from two tightly woven edge strips 21 and a center strip 22, which comprises only threads 23 parallel to each other woven into the edge strips 21. The named central strip 22 can comprise either only chain threads without pick thread or only pick threads without chain threads.

Figure 5B:
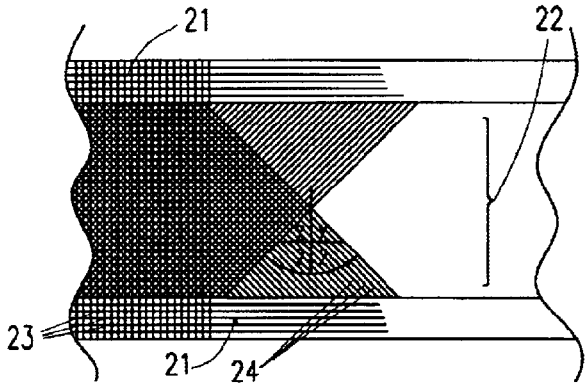

In the embodiment according to FIG. 5*b* the edge strips 21 are constructed as described under FIG. 5*a,* similarly the threads 23 are provided running essentially perpendicular to the edge strips 21. Additionally here two groups of diagonal threads 24, each parallel to one another are woven into the edge strips 21. The two pairs of diagonal threads have an angle a between each other, which in a preferred construction is 90°, whereby the inclination against the direction of the threads 23 for each group of diagonal threads is a/2.

Therewith a web constructed according to FIG. 5*b* can also transmit shear forces running between the upper skin 7 and the lower skin 6 of the couch according to the invention.

Figure 6:
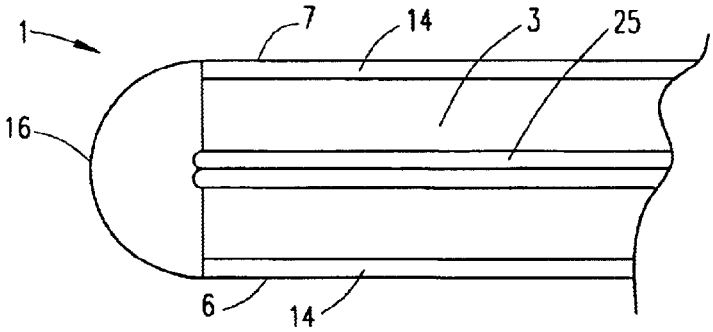

FIG. 6 shows on the basis of FIG. 3, an additional device according to the invention to the subject of the invention. On the web 3—here in the configuration as a textile weave or a plastics material foil, a heating ribbon 25 is fastened. In the finishing part 16 on each side the heating ribbon 25 goes from one web to another. Such heating ribbons are also known for small heating power of a few W/m. A necessary electrical connection for this is taken through the envelope 2 like the valve 9 in an airtight manner. This additional device is especially indicated where the couch 1 according to the invention is to be used in unfavourable climatic conditions. The couch 1 can be either pre-heated only or continually warmed.

Obviously this additional device according to FIG. 6 can also be applied with webs 3 according to FIGS. 5*a, b.* The connection of heating ribbons 25 to the webs 3 is preferably completed by gluing, so that adhesion also to the threads 23, 24 is assured.

What is claimed is:

1. A pneumatic couch comprising:

an airtight envelope divided into a lower skin and an upper skin; and at least one valve for inflation with compressed air and deflation, wherein said airtight envelope comprises low-stretch material;

between the lower skin and the upper skin, a plurality of flexible web arranged running in vertical planes substantially parallel to each other, said flexible webs comprising low-stretch material and being joined over the entire length of said flexible webs both to the lower skin and to the upper skin;

wherein at an upper and a lower end of the couch the airtight envelope overlaps the flexible webs and the lower skin and the upper skin are joined airtight;

wherein the airtight envelope overlaps an outermost web on a first and second long side and the lower skin and the upper skin are joined airtight; and wherein on one long side of the couch both the lower skin and the upper skin continue past the airtight joint, are taken around a rear wall and joined to each other, and form a back part, wherein said back part is substantially of the same length and shape as an adjacent web, and said rear wall is so constructed that said rear wall can be fastened onto a load bearing wall or to a suitable bearing construction; and wherein the couch assumes the shape of a cantilever.

2. The pneumatic couch according to claim 1, wherein the flexible webs comprise a low-stretch textile material.

3. The pneumatic couch according to claim 1, wherein the flexible webs comprise a low-stretch plastics material foil.

4. The pneumatic couch according to claim 2, wherein the textile material comprises woven tapes.

5. The pneumatic couch according to claim 4, wherein the woven tapes comprise on both long edges related to a longitudinal extension of the couch thickly woven edge strip, said edge strips being joined together by threads running parallel to each other, whereby these threads are being woven into the edge strips.

6. The pneumatic couch according to claim 4, wherein the woven tapes comprise on both long edges related to a longitudinal extension of the couch a thickly woven edge strip, said edge strip joined together by two groups of diagonal threads, whereby the diagonal threads include between them an angle a, and the angle of each group to the direction of the width extension of the web is a/2.

7. The pneumatic couch according to claim 6, wherein the angle a is substantially 90°.

8. The pneumatic couch according to claim 1, wherein the webs have the shape of elongated rectangles.

9. The pneumatic couch according to claim 3, wherein the heights of the webs are all the same.

10. The pneumatic couch according to claim 3, wherein the heights of the webs reduce from the wall to a free, unfixed long side of the couch.

11. The pneumatic couch according to claim 1, wherein a free, unfixed long side of the couch comprises a raised edge over its whole length.

12. The pneumatic couch according to claim 2, wherein the height of each individual web increases from its center out of its two ends.

13. The pneumatic couch according to claim 1, further comprising textile T-shaped bands, whereby a vertical web of said T-shaped bands is joined to the flexible webs and a horizontal web of said T-shaped bands is joined to an inner side of the airtight envelope.

14. The pneumatic couch according to claim 13, wherein the joints are created by welding.

15. The pneumatic couch according to claim 13, wherein the joints are created by gluing.

16. The pneumatic couch according to claim 13, wherein the joints are created by sewing and those to the envelope are followed by sealing.

17. The pneumatic couch according to claim 13, wherein means are present for heating the air in the couch.

18. The pneumatic couch according to claim 17, wherein the means for heating comprise electrical heating ribbons.

19. The pneumatic couch according to claim 16, wherein the heating ribbons are fastened to the webs.

20. The pneumatic couch according to claim 2, wherein the webs have the shape of elongated rectangles.

21. The pneumatic couch according to claim 3, wherein the webs have the shape of elongated rectangles.

22. The pneumatic couch according to claim 3, wherein the height of each individual web increases from its center out to its two ends.

* * * * *

UNITED STATES PATENT AND TRADEMARK OFFICE

CERTIFICATE OF CORRECTION

PATENT NO. : 6,643,868 B2
DATED : November 11, 2003
INVENTOR(S) : Andreas Reinhard et al.

It is certified that error appears in the above-identified patent and that said Letters Patent is hereby corrected as shown below:

Column 2,
Equation 1, replace "1/2 $ph_3$" with -- 1/2 $ph_s$ --

Equation 3, replace "$M_B = h_{3/2} x 2 x \sigma \ell = h_B \sigma \ell$" with --$M_B = h_{s/2} x 2 x \sigma \ell = h_s \sigma \ell$--

Equation 4, replace "$P = \frac{b \cdot Gp}{h_B^2 \ell}$" with --$P = \frac{b \cdot Gp}{h_s^2 \cdot \ell}$--

Equation 5, replace "$G = \frac{ph_3^2 \ell}{b}$" with --$G = \frac{ph_s^2 \cdot \ell}{b}$--

Column 3,
Line 4, replace "In FIG 2," with -- In FIG 2 --
Line 5, replace "on for example" with -- on by for example --

Column 4,
Line 46, replace "flexible web arranged" with -- flexible webs arranged --

Column 5,
Line 19, replace "of the web" with -- of the webs --
Line 21, replace "substantially 90°" with -- essentially 90° --

Column 6,
Line 13, replace of its two ends." with -- to its two ends. --

Signed and Sealed this

Twenty-fourth Day of August, 2004

JON W. DUDAS
*Director of the United States Patent and Trademark Office*